United States Patent [19]

Ehrlich, Jr.

[11] Patent Number: 4,510,702

[45] Date of Patent: Apr. 16, 1985

[54] SOLE FOR SHOES AND PROCESS FOR PRODUCING SAID SOLE

[75] Inventor: Johann Ehrlich, Jr., Krems/Weinzierl, Austria

[73] Assignee: Patoflex Corporation, Cave Creek, Ariz.

[21] Appl. No.: 279,237

[22] Filed: Jul. 1, 1981

[30] Foreign Application Priority Data

Jul. 1, 1980 [AT] Austria ..... 3443/80

[51] Int. Cl.[3] ..... A43B 13/08; A43B 13/14

[52] U.S. Cl. ..... 36/86; 36/11.5; 36/31; 36/33; 36/103

[58] Field of Search ..... 36/11.5, 31, 103, 13, 36/14, 23, 24, 85, 33, 100, 101, 30 A, DIG. 2, 44, 86

[56] References Cited

U.S. PATENT DOCUMENTS

| | | | |
|---|---|---|---|
| 1,136,458 | 4/1915 | Woodward | 36/30 A |
| 1,148,584 | 8/1915 | Gerrish | 36/31 |
| 2,607,133 | 8/1952 | Marlowe | 36/11.5 |
| 2,697,255 | 12/1954 | Lindemann | 36/DIG. 2 |
| 3,228,124 | 1/1966 | Schwarz | 36/11.5 |
| 3,952,429 | 4/1976 | Thomas | 36/33 |
| 4,167,824 | 9/1979 | Wolpa | 36/44 |
| 4,177,582 | 12/1979 | Ehrlich, Jr. | 36/33 |
| 4,335,528 | 6/1982 | Watanabe | 36/30 R |

FOREIGN PATENT DOCUMENTS

| | | | |
|---|---|---|---|
| 358308 | 4/1938 | Italy | 36/33 |
| 1166585 | 10/1969 | United Kingdom | 36/33 |
| 2059745 | 4/1981 | United Kingdom | 36/31 |

*Primary Examiner*—Werner H. Schroeder
*Assistant Examiner*—Steven N. Meyers
*Attorney, Agent, or Firm*—Salter & Michaelson

[57] ABSTRACT

The sole for shoes comprises at least a substantially rigid rear portion and a flexible front portion connected with said rear portion approximately at the area of the ball of the foot. One of said both portions, preferably the rear portion, consists of a material having a cell structure, the cells of this portion being at least partially opened at the connecting surface with the other portion. This other portion, preferably the front portion, is formed of a synthetic plastics material being connected with said first portion by foaming thereto. Suitably the portion foamed onto the other portion consists of polyurethane.

25 Claims, 2 Drawing Figures

SOLE FOR SHOES AND PROCESS FOR PRODUCING SAID SOLE

BACKGROUND AND SUMMARY OF THE INVENTION

The invention refers to a sole for shoes consisting of at least one substantially rigid rear portion and a flexible front portion connected with said rear portion approximately at the area of the ball of the foot. In the following the term "sole" is to comprise shoe soles of any kind such as running soles, intermediate soles, plateau soles, foot bed soles, welts, covering welts and insoles loosely to be inserted into a shoe, but also combinations of these soles as for example a combination of a welt, of an intermediate sole and of a running sole.

Known rigid soles have the advantage to support the foot in an orthopaedically favourable manner. A suitable material for rigid soles is wood, laminated wood or compressed wood included, but also cork, leather fibre materials and synthetic plastics materials can be used if they have the required strength.

It is a drawback of such completely rigid and thus not bendable soles that the stiffness of the soles at the area of the ball of the foot represents a hindrance for the rolling movement of the foot on walking and that this stiffness can, under circumstances, also be detrimental to health. For the purpose of avoiding this drawback there have already been proposed soles consisting of a substantial rigid rear portion and of a flexible front portion connected with said rear portion approximately at the area of the ball of the foot. With known soles of this type it is, however, difficult to provide a permanent connection between the substantially rigid rear portion and the flexible front portion because it is just this connecting area which is, when using shoes provided with such soles, subjected to continuous bending stresses. It has been found that usual glued connections do not withstand such bending stresses and that the sole does show after some time at least fissures at the connecting area and that therefore a shoe provided with such a sole becomes useless.

It is an object of the present invention to provide a sole in which a permanent or durable connection between the substantially rigid rear portion and the flexible front portion is reliably established. It is a further object of the invention to provide a sole which can be produced in a simple and inexpensive manner. It is a further object of the invention to provide a sole consisting of individual portions and having on the upper side of the sole at the connecting area neither disturbing elevations nor disturbing depressions.

BRIEF DESCRIPTION OF THE DRAWINGS

In the annexed drawings, the invention is schematically illustrated with reference to embodiments.

FIG. 1 shows a sole designed according to the invention in a section in longitudinal direction of the sole, said sole being intended to be used for a ladies shoe, whereas

DETAILED DESCRIPTION OF THE DRAWINGS

Figure 1:
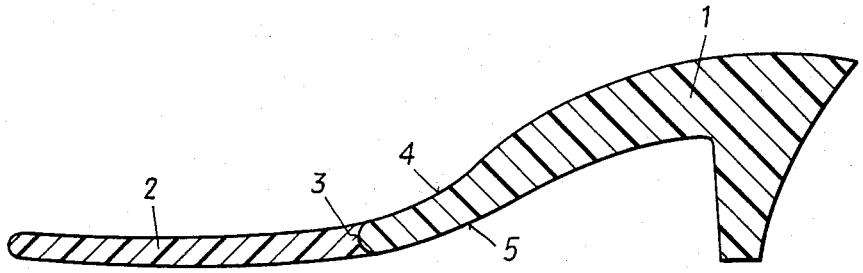

The soles shown in the drawings consist of a substantially rigid rear portion 1 and of a flexible front portion 2 connected to said rear portion. With the sole shown in FIG. 1 and to be used for a ladies shoe, the substantially rigid rear portion 1 is formed of a polymer having cell structure, for example of a foamed hard polyurethane or of foamed polyvinyl chloride or polystyrene. The portion having cell structure can, however, comprise a wood material such as wood per se, cork, wood arranged in layers, cork arranged in layers and/or of combinations of these materials arranged in layers. If the portion having cell structure is formed of polymers and if also the portion foamed thereto consists of such polymers, a chemical bond between both portions is obtained on account of chemical reactions between the polymers in addition to the mechanical bond. If a material such as wood or cork is used as the material for the portion having cell structure and if the portion foamed thereto consists of polyurethane there is equally obtained, in addition to the mechanical bond achieved by the material penetrating the open cells, a chemical bond because wood and cork contain OH-groups which inseparably combine in a chemical reaction with the isocyanate groups of the polyurethane. Bending tests performed with such soles have shown that the bond between the substantially rigid rear portion and the flexible front portion withstands a very high number of bending cycles.

The flexible front portion 2 can consist of foamed polymers having a hardness of 26 to 98 Shore A, preferably 45 to 78 Shore A, and having a density of 0.3 to 0.95, preferably 0.45 to 0.78. In such a case and when using polymers for the substantially rigid rear portion 1 as well as for the flexible front portion 2 a chemical bond can be obtained by chemical reaction between the polymers in addition to the mechanical bond achieved by the material penetrating the open cells of one of both portions when foaming the other of both portions. The flexible front portion 2 preferably consists of polyurethane foamed onto the substantially rigid rear portion 1. Filling materials, i.e. either wood particles, cork particles and/or leather particles, in particular leather fibre materials, can be embedded within the substantially rigid rear portion 1, which filling materials are materials equally showing a cell structure. When using such filling materials one can not only save polymer materials but the substantially rigid rear portion becomes stiffened and reinforced and, in addition, a special appearance of the surface of the rear portion is obtained by such filling materials. It is, however, also possible to use as the filling material embedded within the substantially rigid rear portion 1 minute bubbles, the thin shell of which consists of an elastic vinylidene chloride copolymer and/or a vinyl chloride copolymer and the hollow core of which contains a gas, preferably air. In such a case it is not necessary to form the substantially rigid rear portion of foamed polymers having a cell structure originating from the foaming process, but a cell structure is formed by embedding such bubbles into the polymers, so that the same effect is obtained as is obtained when using foamed polymers.

It is of particular advantage if the substantially rigid rear portion 1 consists of polyurethane foamed within a mold. In such a case a predominantly open cell structure, i.e. a structure is obtained in which the cells are in connection one with the other so that the material forming the flexible front portion 2 can deeply penetrate into the cells of the substantially rigid rear portion 1 and thus a very strong mechanical bond is obtained. However, also the substantially rigid rear portion can consist of expandable homopolymers, copolymers and mixed polymers, optionally having incorporated therein filling materials, having a hardness of more than 60 Shore D, such as polyvinyl chloride or polystyrene. Such materials have a predominantly closed cell structure, i.e. a structure in which the cells are for the major part not in connection one with the other, but also in this case a good mechanical bond with the flexible front portion can be obtained in view of the great number of cells.

For reliably obtaining a good bond between the substantially rigid rear portion 1 and the flexible front portion 2 also if the connection is only effected over the connecting surface 3 over which the front portion 2 is immediately adjoining the rear portion 1, this connecting surface 3 of the front portion 2 has a groove and is preferably concave in shape. This does not only enlarge the connecting surface 3 in comparison to a plane connecting surface but it is also possible to provide a stepless transition between the substantially rigid rear portion 1 and the flexible front portion 2, in particular if the marginal portions of the connecting surface of the front portion 2 have a tangential transition area relative to the top surface and/or the bottom surface of the rear portion. Such a stepless transition is of particular importance at the top surface of the sole for obtaining a good wearing comfort.

Figure 2:
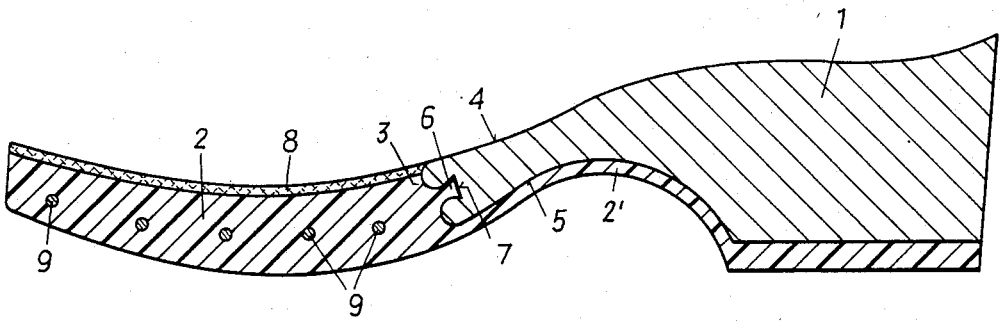
FIG. 2 shows a sole for a clog.

In the embodiment shown in FIG. 2, the substantially rigid rear portion 1 consists of wood and the flexible front portion 2 consisting for example of polyurethane is foamed to said wooden portion. As can be derived from the drawing, the front portion 2 protrudes at its bottom side beyond the rear portion 1 and is integrally formed with a protrusion 2' extending along the rear portion 1 and being foamed onto the bottom surface 5 of the rear portion 1. In such an embodiment, the connection between the front portion 2 and the rear portion 1 is not only effected along the connecting surface 3 where the front portion 2 and the rear portion 1 are mutually connecting one the other, but the connection is also effected by means of the protrusion 2' being integral with the front portion 2 and being foamed onto the bottom surface of the rear portion 1, thus still further increasing the strength of this connection. Such an embodiment has the additional advantage that the protruding area of the front portion 2 and the protrusion 2' foamed onto the rear portion can already form the running sole so that one can do without a separate running sole still to be fixed.

The connecting surface 3 of the front portion again is concave in shape and has a tangential area of transition relative to the top surface 4 as well as relative to the bottom surface 5 of the substantially rigid rear portion 1. In this embodiment, a protrusion 6 is, however, protruding from the center area of the connecting surface 3 and is engaging a dove tail-shaped recess 7 of the rear portion 1 thus still further improving the connection between the front portion and the rear portion.

As can be further derived from FIG. 2, the flexible front portion 2 consisting of foamed polyurethane has a top layer 8 of laminated wood, cork or leather for improving the wearers comfort. In case the top layer 8 consists of leather, said top layer can extend up to the substantially rigid rear portion 1 because the leather can follow the bending movements at the area of the ball of the foot located at the connecting area between the substantially rigid rear portion and the flexible front portion 2. When using laminated wood or cork it is, however, convenient that the top layer 8 does not extend up to the substantially rigid rear portion 1 for not obstructing the bending movement at the area of the ball of the foot. In such a case, an elastic and flexible intermediate piece can be inserted between the substantially rigid portion and the top layer.

In the embodiment according to FIG. 2, anchoring bodies, fixing parts or the like 9 are provided within the flexible front portion 2 and are extending up to the lateral border of the front portion 2. These anchoring bodies, fixing means or the like 9, which serve the purpose to firmly fix the upper of the shoe to the sole at the area of the front portion 2, can, for example, be formed of tension pins consisting of a metallic tubelet slotted in longitudinal direction and within which pins, nails, clamps, screws, in particular screws having a self-cutting thread, and so on, protruding through the upper of the shoe can be anchored. It is, however, also possible to make the anchoring bodies, fixing means or the like 9 of a wooden pin, into which nails or screws can be driven, or of a cylinder of synthetic plastics material provided with openings into which pins, bolts or the like are equally insertable. Finally, the anchoring bodies, fixing means or the like 9 can be provided with extensions protruding beyond the lateral borders of the front portion 2 and extending through the upper of the shoe and being adapted to be deformed to a rivet head. Said extensions can also be provided with a screw thread onto which a nut can be screwed.

When producing a sole according to the invention, the substantially rigid rear portion 1 is at first preformed and the preformed part is put into a mold. If the substantially rigid rear portion 1 consists of wood or cork, a pretreatment of the connecting surface 3 is, as a rule, not required because these materials have open cells at any rate. If, however, the substantially rigid rear portion 1 consists of a polymer, for example polyvinyl chloride or polystyrene, having cell structure, the cells must be opened at the connecting surface 3 and optionally also at the bottom surface 5. For this purpose, said surfaces are either mechanically roughened or chemically pretreated with a solvent. A suitable solvent is, for example, dimethylformamide when using foamed polyurethane and toluene when using polystyrene. After having introduced the substantially rigid rear portion 1 into the mold, the anchoring bodies, fixing means or the like parts 9 and/or the top layer 8 are, if provided, put into the mold whereupon the material forming the flexible front portion 2 is filled into the mold and the mold is subsequently closed and said material is allowed to cure with the mold closed. It is also possible to close the mold after having inserted therein the substantially rigid rear portion 1 as well as the optionally provided anchoring bodies, fixing means or the like parts 9 and/or the top layer and subsequently to inject, if desired under pressure, via an opening into the mold the material forming the flexible front portion 2.

After removal of the sole from the mold, the sole is worked at least at the surface facing the foot sole and preferably also at the side surfaces, for example by grinding or milling operation.

Although in the above description there is always spoken of first preforming the substantially rigid rear portion and then foaming onto the rear portion the flexible portion 2, a reverse procedure is in principle also possible during which first the flexible front portion 2 is produced, noting that this front portion 2 can already be provided with the anchoring bodies, fixing means or the like parts 9 and/or with the top layer 8, then this front portion 2 is, after roughening the connecting surface 3 engaging the rear portion 1, put into a mold and subsequently the rear portion, consisting for example of hard polyurethane, is foamed onto said front portion. Also in this case a reliable and strong and permanent connection is obtained between the front portion and the rear portion.

What I claim is:

1. A sole for shoes and the like comprising a substantially rigid rear portion, a flexible front portion connected to said rear portion approximately at the area of the ball of the foot, and a protrusion which integrally extends from the bottom side of said front portion along at least a portion of the bottom side of said rear portion, said rear portion comprising a substantially rigid material having a porous cellular structure and having an at least partially open porous cellular structure in at least the generally forwardly facing portion of the area of interconnection thereof to said front portion, said front portion and said protrusion comprising a flexible synthetic plastic material, and both being connected to said rear portion by foaming.

2. Sole as claimed in claim 1 wherein the portion foamed onto the other portion consists of polyurethane.

3. Sole as claimed in claim 1 wherein the flexible front portion consists of a polymer foamed onto the other portion and having a hardness of 26 to 98 Shore A and a density of 0.3 to 0.95.

4. Sole according to claim 3 wherein the flexible front portion consists of polymers foamed to the other portion having a hardness of 45 to 78 Shore A and a density of 0.45 to 0.78.

5. Sole as claimed in claim 1 wherein the top side of at least the front portion is provided with a top layer.

6. Sole as claimed in claim 5 wherein the top layer consists of laminated wood.

7. Sole as claimed in claim 5 wherein the top layer consists of cork.

8. Sole as claimed in claim 5 wherein the top layer consists of leather.

9. Sole as claimed in claim 1 wherein the connecting surface of the front portion, by means of which said front portion is connected with the rear portion, having a groove therein.

10. Sole as claimed in claim 9 wherein the connecting surface of the front portion, via which this front portion is connected with the rear portion, is concave in shape.

11. Sole as claimed in claim 9 wherein the upper portions of the connecting surface of the front portion tangentially pass over into the top surface of the rear portion.

12. Sole as claimed in claim 9 wherein the lower portions of the connecting surface of the front portion tangentially pass over into the bottom surface of the rear portion.

13. Sole as claimed in claim 9 wherein at the center area of the connecting surface of the front portion there protrudes at least one protrusion engaging a correspondingly shaped recess of the rear portion.

14. Sole as claimed in claim 13 wherein the recess is enlarging in direction to the interior of the rear portion.

15. Sole as claimed in claim 14 wherein the recess has a dove tail-shape.

16. Sole as claimed in claim 1 wherein at least one anchoring means is provided within the front portion and transversely extends relative to the longitudinal direction of the sole and is extending at least up to the lateral border of the front portion, said anchoring means serving the purpose of connecting the front portion with the upper of the shoe.

17. Sole as claimed in claim 16 wherein an anchoring body is provided which extends over the whole width of the front portion.

18. Sole as claimed in claim 16 wherein the anchoring means is provided with openings at its ends extending up to the lateral border of the front portion, said openings being adapted to accommodate pins, nails, clamps or bolts extending through the upper.

19. Sole as claimed in claim 16 wherein the anchoring means is provided with extensions protruding from the lateral borders of the front portion and extending through the upper.

20. In the sole of claim 1, said wood material further characterized as comprising wood.

21. In the sole of claim 1, said wood material further characterized as comprising cork.

22. In the sole of claim 1, said rear portion further characterized as comprising a plurality of layers of the same wood material.

23. In the sole of claim 1, said rear portion further characterized as comprising a plurality of layers of different wood materials.

24. In the sole of claim 1, said front portion and said protrusion defining a running sole.

25. A sole for shoes and the like comprising a substantially rigid rear portion, a flexible front portion connected to said rear portion approximately at the area of the ball of the foot, and a protrusion which integrally extends from the bottom side of said front portion along the bottom side of said rear portion, said rear portion comprising a substantially rigid material having a porous cellular structure and having an at least partially open porous cellular structure at the area of interconnection thereof to said front portion, said front portion and said protrusion comprising a flexible synthetic plastic material, and both being connected to said rear portion by foaming.

* * * * *